United States Patent [19]

Larson

[11] 4,407,147

[45] Oct. 4, 1983

[54] PERIPHERAL KEY TUMBLER LOCK

[75] Inventor: Wayne F. Larson, Salem, Oreg.

[73] Assignee: Supra Products, Inc., Salem, Oreg.

[21] Appl. No.: 218,720

[22] Filed: Dec. 22, 1980

[51] Int. Cl.[3] ..... E05B 29/02

[52] U.S. Cl. ..... 70/365; 70/407; 70/409

[58] Field of Search ..... 70/365, 366, 362, 407, 70/408, 409

[56] References Cited

U.S. PATENT DOCUMENTS

| | | | |
|---|---|---|---|
| 688,070 | 12/1901 | Denn | 70/366 |
| 1,553,639 | 9/1925 | Sherman | 70/408 |
| 1,915,897 | 6/1933 | Maxwell | 70/407 |
| 2,578,211 | 12/1951 | Spain | 70/366 |
| 3,334,501 | 8/1967 | Greenwald | 70/408 |
| 3,821,886 | 7/1974 | Ledewig | 70/366 |

FOREIGN PATENT DOCUMENTS

| | | | |
|---|---|---|---|
| 417594 | 9/1974 | U.S.S.R. | 70/366 |

*Primary Examiner*—Robert L. Wolfe
*Attorney, Agent, or Firm*—Klarquist, Sparkman, Campbell, Leigh, Whinston & Dellett

[57] ABSTRACT

A two-stage tumbler lock wherein there are two sets of discs, one set being actuatable by a key to free the second set for unlocking movement under the influence of the key. The invention also contemplates a lock designed to receive a peripheral key to cause the above operations.

The invention further contemplates a dog leg key particularly a peripheral dog leg key for effecting the above operations.

The invention still further contemplates a lock having a peripherally located reset member which makes picking most difficult. A further feature of the lock and its key is that the two coact to perform their intended functions in a manner such that the key cannot be withdrawn from the lock until it is returned to the position it first assumed when inserted into the lock.

Another feature of the invention is a disc lock in which the discs have spaced lugs defining the extent of disc movement in regard to a locking member.

A still further feature of the invention is the provision of a set of plugs in the lock coacting with an axial member and plural discs.

14 Claims, 23 Drawing Figures

FIG. 11
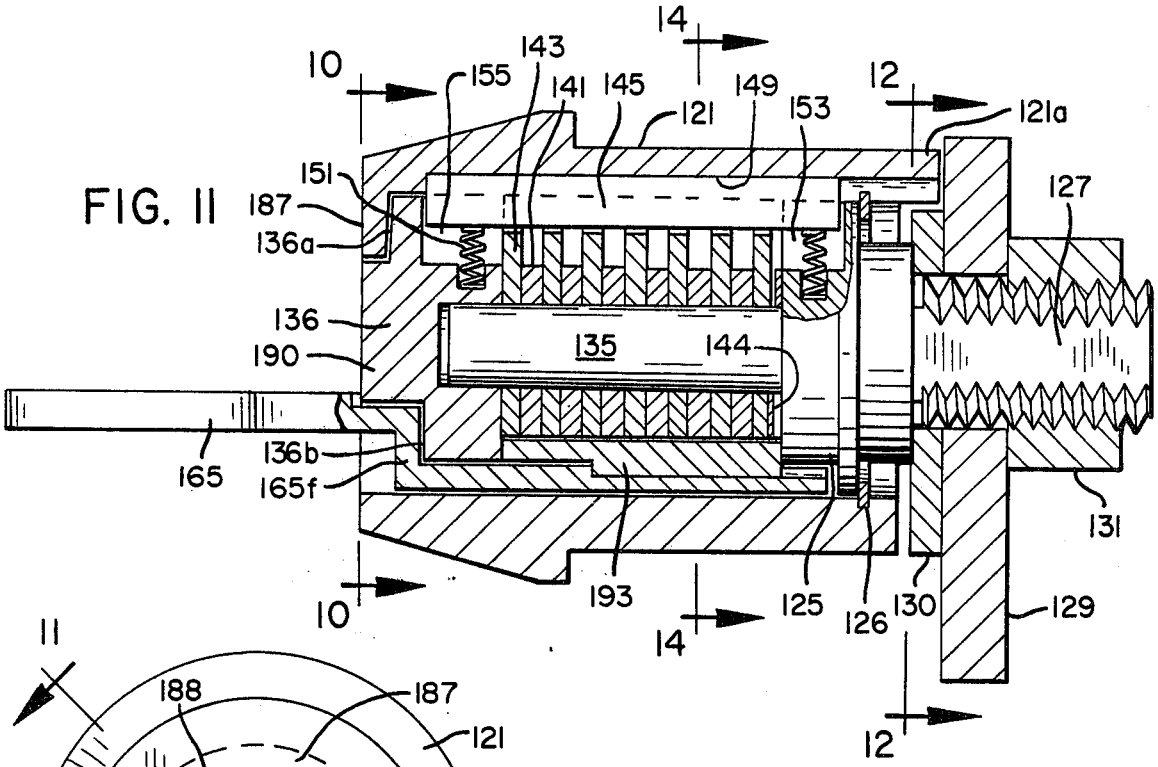
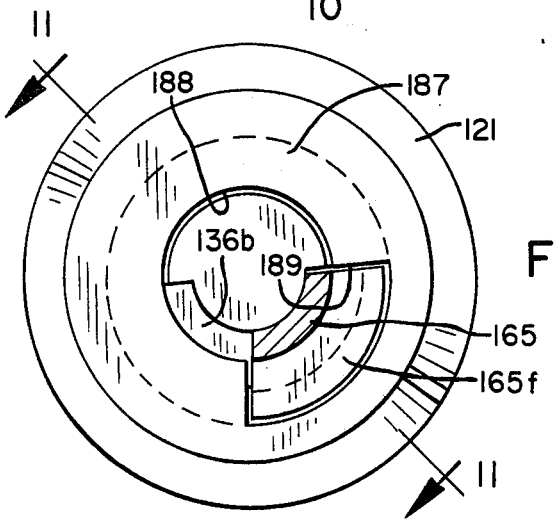
FIG. 10
FIG. 12
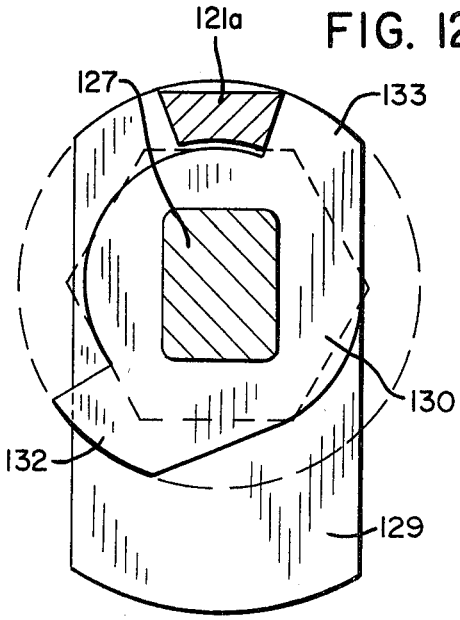

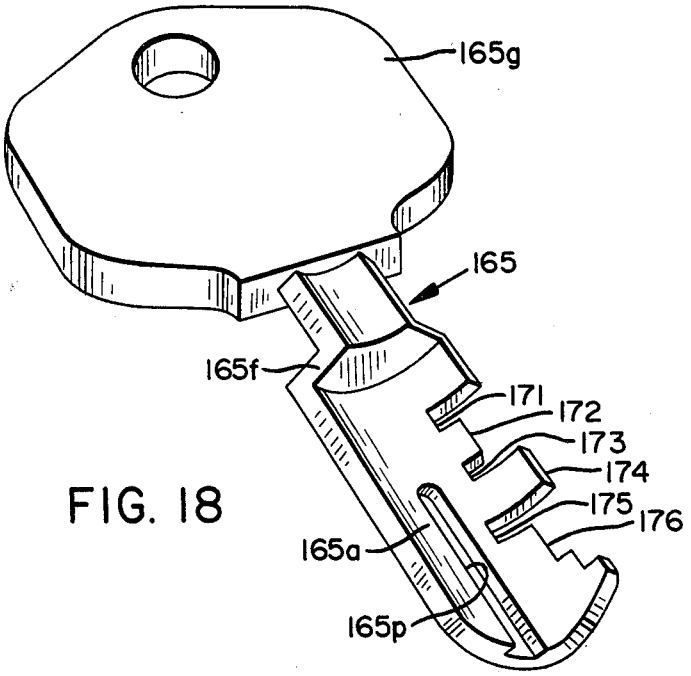
FIG. 18
FIG. 21
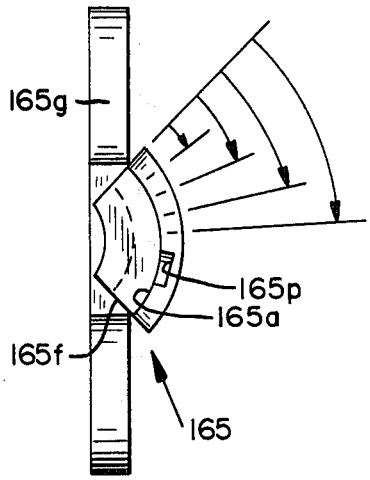
FIG. 19
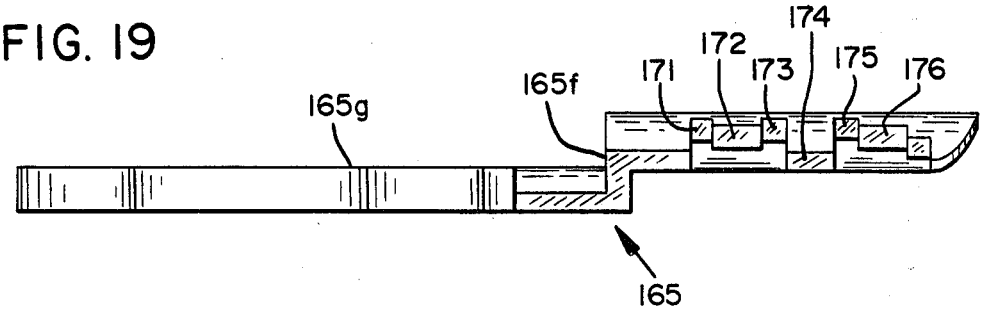
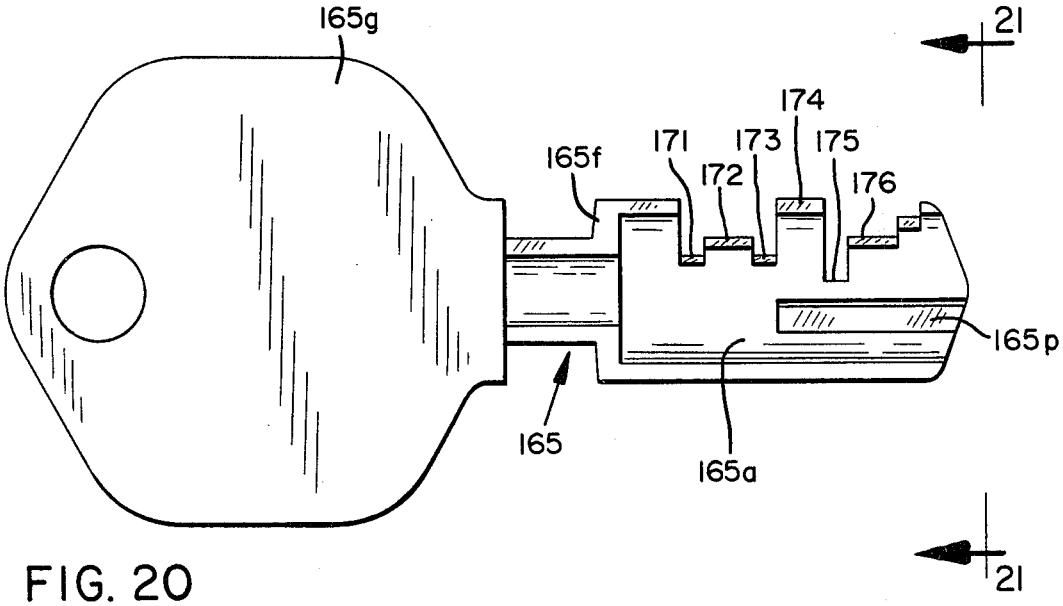
FIG. 20

PERIPHERAL KEY TUMBLER LOCK

FIELD AND BACKGROUND

The present invention relates to tumbler locks and particularly to two stage tumbler locks. The "Abloy" lock, one advanced form of which is shown in U.S. Pat. No. 3,621,689, is a two stage lock now in common usage. Similar locks are shown in the patents to Welch U.S. Pat. No. 2,862,380 and Henriksson U.S. Pat. No. 1,514,318. These various locks have, in common, a housing containing a cylinder which carries a locking member to be moved to and from a locking position. The cylinder is latched to the housing by one or more tumblers. Plural code discs retain the tumblers in latching position. A key is axially inserted into the code discs and is turned to move them to aligned positions. This first stage movement allows the tumblers to unlatch themselves from the cylinder and establish a latching relationship with the discs. Then, second stage movement of the key causes the cylinder to turn, to turn the locking member from its locking to its unlocking position. Relocking is achieved by reverse rotary movement of the key.

A primary object of two stage locks is to make them more secure, i.e., more difficult to pick. The present invention has for its primary object to provide a two stage tumbler lock which is even more difficult to pick than prior two stage locks.

An important feature of the new lock is that instead of having an axially disposed key, it has a peripheral one. This change, coupled with changes in the relationship of the peripheral key to certain other parts, including discs, make the disc bits even more inaccessible than before. Inaccessibility is further enhanced by the provision of a guide or pusher plate to receive the key, and by providing a dog leg in the key so that the inner key portion moves behind the front face of the housing when the key is rotated. Another feature of the new lock is that it has two sets of discs, a first set of actuating discs latched by tumblers to the housing and carrying a locking member, and code discs to hold the tumblers in latching relationship to the housing until the code discs are properly selectively rotated by the peripheral key.

A further feature of the lock is that the key has a camming portion engaging the discs at the time of insertion of the key to bring the discs into desired initial positions prior to rotation of the key.

The subject matter which I regard as my invention is particularly pointed out and distinctly claimed in the concluding portion of this specification. The invention, however, both as to organization and method of operation, together with further advantages and objects thereof, may be best understood by reference to the following drawings, wherein like reference characters refer to like elements.

BRIEF DESCRIPTION OF THE DRAWINGS

FIG. 10 is a front view of the lock and key of the preferred form of the invention;

FIG. 11 is a longitudinal midsectional view taken along line 11—11 of FIG. 10;

FIG. 12 is a cross sectional view taken along lines 12—12 of FIG. 11;

FIG. 18 is a perspective view of the key for the preferred form of the invention;

FIG. 19 is a side view of the key of FIG. 18;

FIG. 20 is a plan view of the key of FIG. 18;

FIG. 21 is an end view of the key taken in the direction of the arrows 21—21 of FIG. 20;

DESCRIPTION

Figure 2:
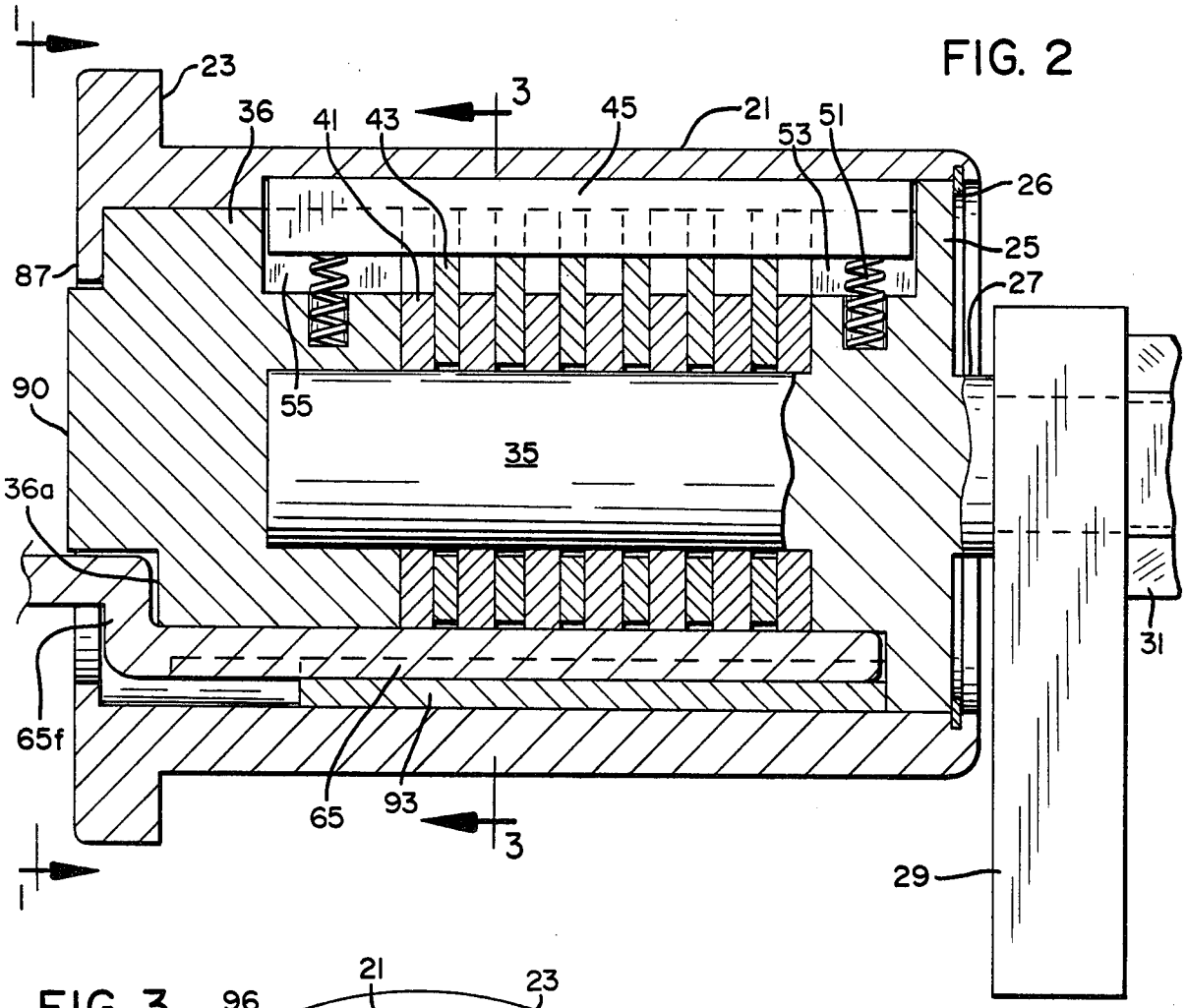
FIG. 2 is a longitudinal sectional view taken along line 2—2 of FIG. 1 on an enlarged scale.
Figure 1:
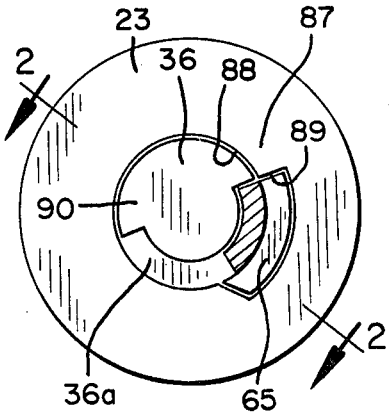
FIG. 1 is a sectional elevational view of one form of lock embodying the concepts of the present invention, the view being taken along line 1—1 of FIG. 2.

Referring to FIGS. 1 and 2, the lock has a cylindrical housing 21 having an outer flange 23 at its front end. The lock is designed to fit through a non-circular hole provided in a mounting plate, the housing having flats 24 (FIG. 3) to fit the contour of the hole to non-rotatably mount the housing in place. The exterior surface of the housing is threaded (not shown) so that a nut (not shown) with or without a lock washer, can be used to clamp the housing onto the plate. The plate can be the front wall of a a key-containing safe, or the lock can be mounted in any manner, wherever desired.

Figure 3:
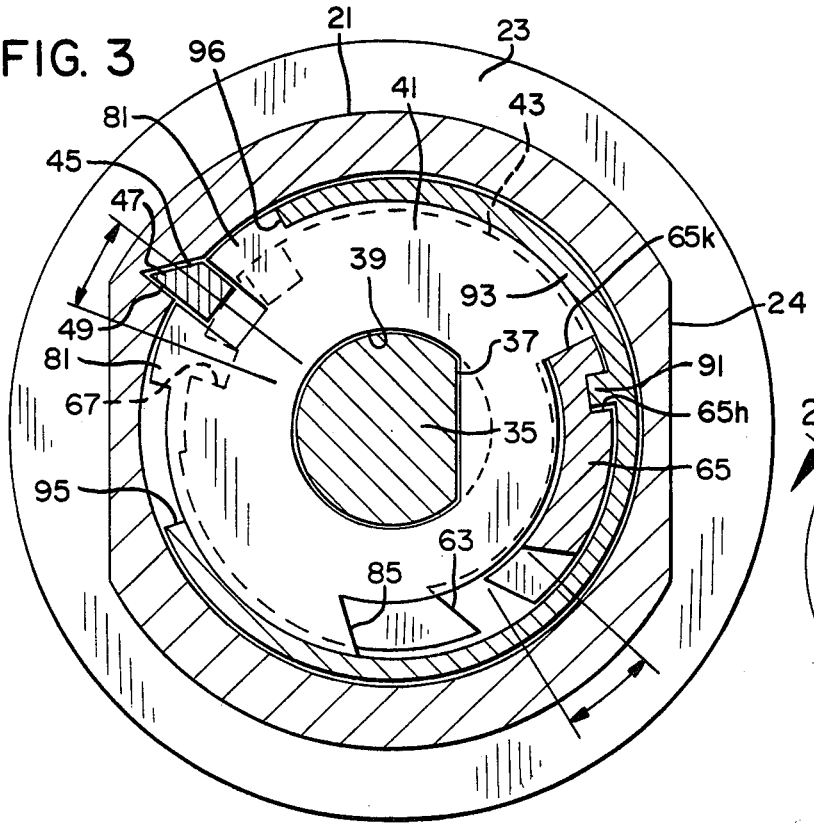
FIG. 3 is a cross sectional view taken along line 3—3 of FIG. 2.

At the rear of the housing is a plug 25, retained in place by a snap ring 26, having a rearwardly projecting stub shaft 27 on which is fixedly mounted a locking member 29, held in place by a nut 31. The plug has a forwardly projecting integral shaft 35, which is non-circular, being provided with a flat 37 (FIG. 3). The forward end of the shaft 35 nonrotatably fits in a bore provided in a front plug 36, which is rotatably mounted in the housing 21. The medial portion of the shaft 35 slidably but nonrotatably fits through the similar non-circular holes 39 (FIG. 4) provided in plural actuating discs 41, but rotatably extends through circular holes 42 provided in plural code discs 43 (compare FIGS. 3 and 4).

The peripheries of the code discs 43 (FIG. 2) releasably retain a tumbler 45 in its outward position, where its outer triangular end portion 47 (FIG. 3) fits within a triangular notch 49 formed in the interior of the housing 21. A pair of compression springs 51 (FIG. 2) seated in bores in the plugs 25 and 36 urge the tumbler 45 to remain seated within the notch or groove 49.

The plugs 25 and 36 have slots 53 and 55, respectively, formed therein, to at all times slidably receive the end portions of the tumbler 45. Thus, so long as the tumbler is captured by the notch 49, the plugs cannot turn.

Figure 4:
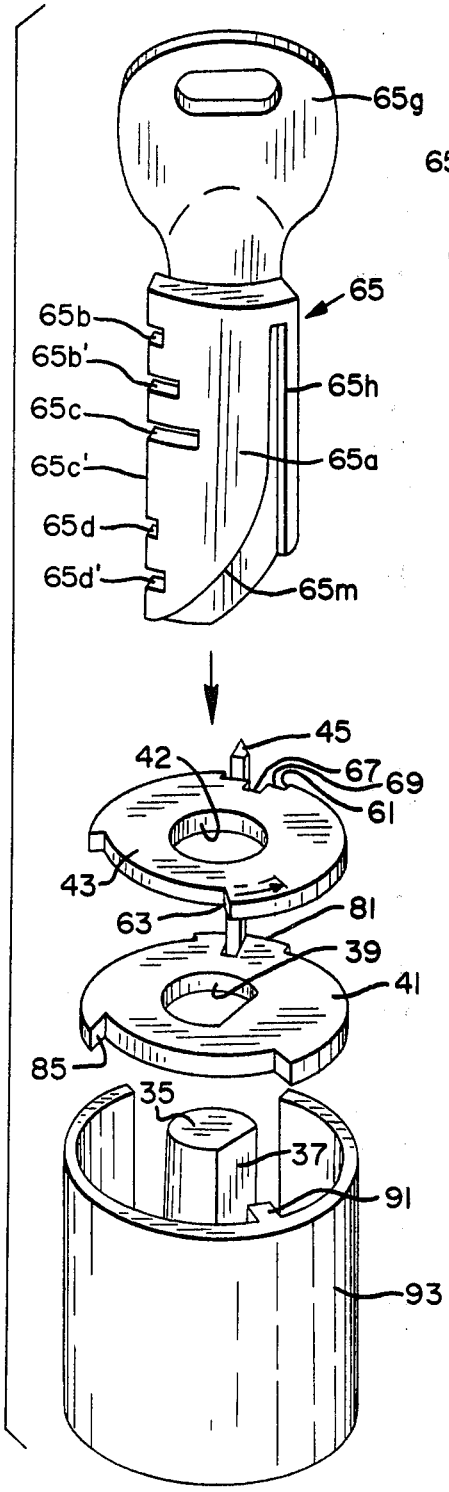
FIG. 4 is an exploded view showing the key and certain of the components of the lock.

Referring particularly to FIGS. 2 and 4, it is evident that the code discs are circular except for having two peripheral notch portions, a double notch portion 61 accommodating the tumbler 45, and a single wide notch portion 63 for receiving a key, generally entitled 65. The notch portion 61 comprises a wide shallow notch portion interrupted by a deeper and narrower code notch 67 for receiving the tumbler when the tumbler is brought into alignment with the notch. However, as the parts are shown in FIG. 4, the tumbler rests upon a land 69 defining the bottom of a wide notch portion.

The notches 67 are formed in the discs in various positions along the length of the lands 69, the lower one in FIG. 4 happens to be centrally disposed, but it can be disposed at either end of the land or anywhere in between. So long as any one of the code discs 43 has its notch 67 misaligned with the tumbler 45, the tumbler cannot move inwardly from its latching position. So long as the tumbler is in its latching position, the locking member 29 is held in its locking position as shown in FIG. 2.

Again referring to FIGS. 2–4, the actuating discs 41 are of a somewhat different form as compared to the code disc 43. Each has a generally circular periphery which is interrupted by a pair of lugs 81 which define a deep notch 83 to at all times slidably receive the tumbler 45, whether the tumblers is in its outer position or its inner position. The actuating disc has a wide notch 85 formed generally opposite the lugs 81 to accommodate the key 65.

Note that FIG. 4 shows that the actuating disc has a non-rotatable connection with the shaft 35, whereas the code disc has a rotatable relationship. This permits the code disc to be adjusted to desired positions relative to the shaft 35, while the latter is stationary.

Figure 5:
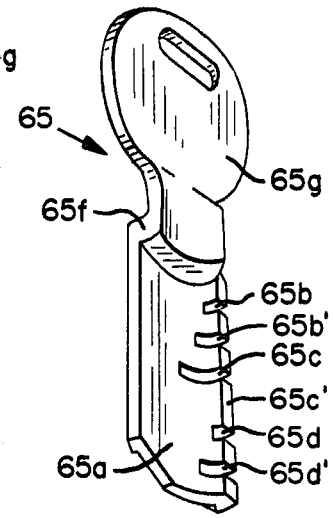
FIG. 5 is a view of the key from the opposite side from that shown in FIG. 4.
Figure 6:
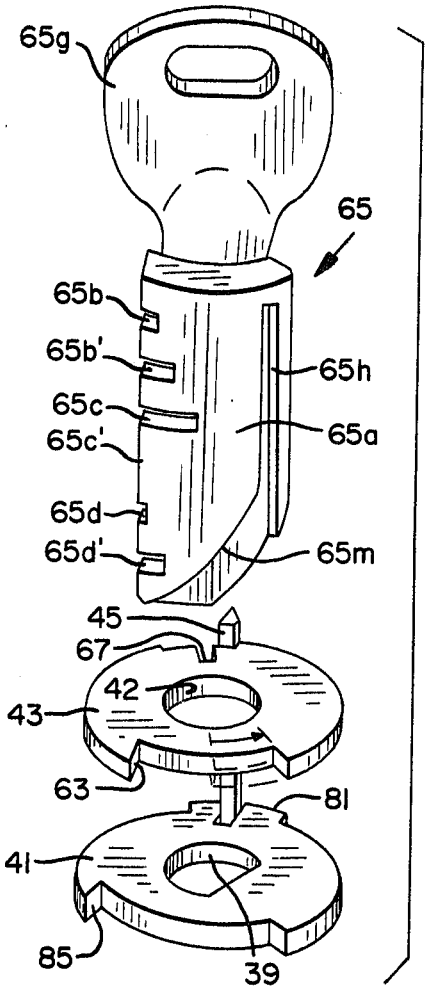
FIG. 6 is an exploded view showing the key and certain components of the lock.
Figure 7:
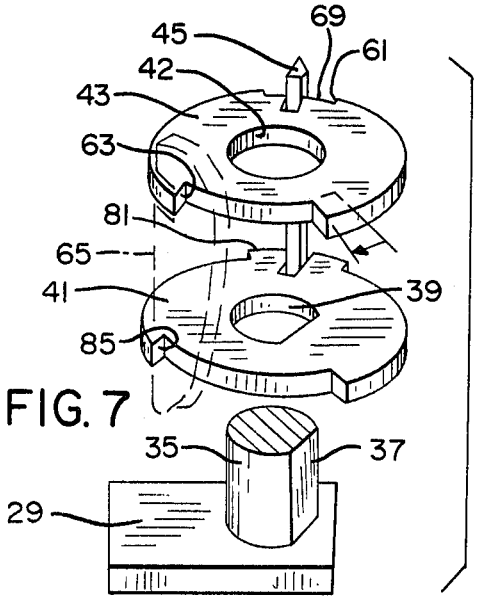
FIG. 7 is an exploded view showing the tumbler disposed within the disc slots.

Referring to FIGS. 4–6, the peripheral key is shown as having an arcuately curved operative portion **65*a* notched on one edge to provide six bits 65*b*, 65*b*′, 65*c*, 65*c*′, 65*d*, and 65*d*′**, one for each of the code discs. It will be understood that the key is formed with as many bits as there are code discs.

The key is formed with a dog leg **65*f* (FIGS. 2 and 5) to dispose the handle portion 65*g* of the key in offset relationship to the operative portion 65*a***. The housing and internal parts are specially formed to accommodate the unusual shape and position of the key.

As best shown in FIGS. 1 and 2, the housing has an inwardly extending flange 87 at its front end formed with a circular hole 88, such hole being interrupted by a notch 89, as is shown in FIG. 1. Note that the front plug 36 has a forwardly projecting portion 90 (FIG. 1) which closes off the parts of the hole 88.

When the key is to be inserted into the lock, it will be assumed that the parts will be disposed as shown in FIG. 3, with the wide notches 63 of the code discs and the wide notches 85 of the actuating discs in general alignment with the notch 89 in the inner flange 87. The plug 36 is suitably recessed to provide a space as shown in FIG. 1, to accommodate the key. Thus the key can be inserted into the lock through the front opening 88 and the notch 89 to assume the FIG. 2 position. Note that when the key is thus inserted, the dog leg **65*f* is disposed axially rearwardly of the rear face of the inner flange 87 of the housing 21. This enables the key to be turned to a position to locate the operative portion 65*a* of the key behind the unnotched portion of the flange 87** to attain advantages to be presently set forth.

The plug 36 may be considered as having started out as a solid cylinder of a size to rotatably fit within the cylindrical interior of the housing 21, but which has been modified as follows:

(1) formed with a bore the same shape as the shaft 35 to non-rotatably receive the left hand end portion of the shaft;

(2) slotted at 55 to slidably receive the left hand end portion of tumbler 45;

(3) concentrically reduced to provide a forward or left hand projecting pilot portion 90;

(4) cut away on its lower sidesemi-cylindrically to provide a curved recess which not only accommodates the key and the forward portion of the guide plate, but also accommodates relative movement of these two members around the housing to the point where the code disc notches are aligned; (plug 26 is similarly arcuately recessed).

(5) cut away forwardly and semi-cylindrically to provide a curved recess which accommodates the dog leg **65*f* and its necessary movement, and leave a forwardly directed arcuate face 36*a***.

Points (3), (4) and (5) above mean, as evident from FIG. 1, that when the key is removed, the semi-cylindrical recess for the key and pusher plate will be exposed at the notch 89. However, it will not be exposed elsewhere, because of being covered by the flange 87. It is the face **36*a* that is exposed to the left of the key 65 in FIG. 1**.

Before describing the relationship of the key and the discs, it is pointed out that the key is formed with a longitudinal keyway **65*h* (FIGS. 3 and 4) to receive a keying portion 91 of a curved sleeve-like guide plate 93. The curved guide plate nests within the interior of the cylindrical housing 21 (FIG. 3), its position being determined by the position of the key 65**.

The guide plate is not a complete circle, being interrupted, having end edges 95 and 96 (FIG. 3) so spaced apart as to provide adequate clearance for movement of the guide plate without either of such edges coming into engagement with the lugs 81 of the actuating discs 41. That is to say, when the key 65 is turned clockwise as the parts are shown in FIG. 3, it will move within the wide notches 63 and 85 of the code and actuating discs, respectively. The guide plate of course moves with the key, but its forward edge 95 is sufficiently spaced from the lugs 81 on the actuating discs so that it does not contact them.

Figure 8:
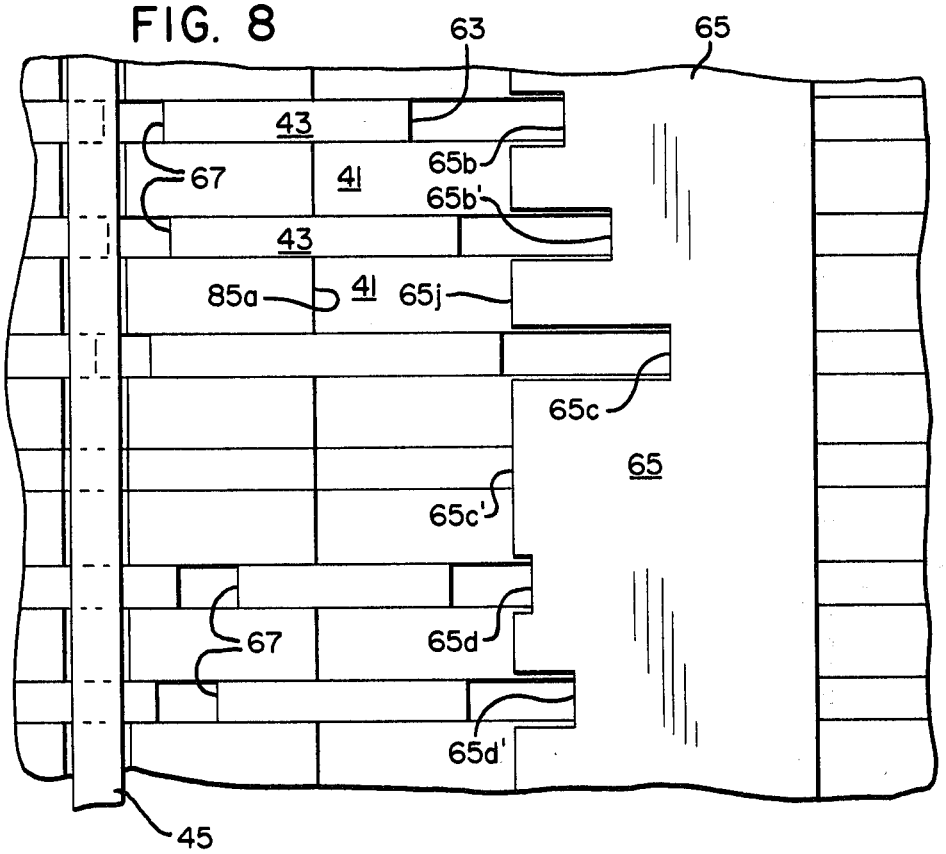
FIG. 8 is a fragmentary schematic view of the discs and key.
Figure 9:
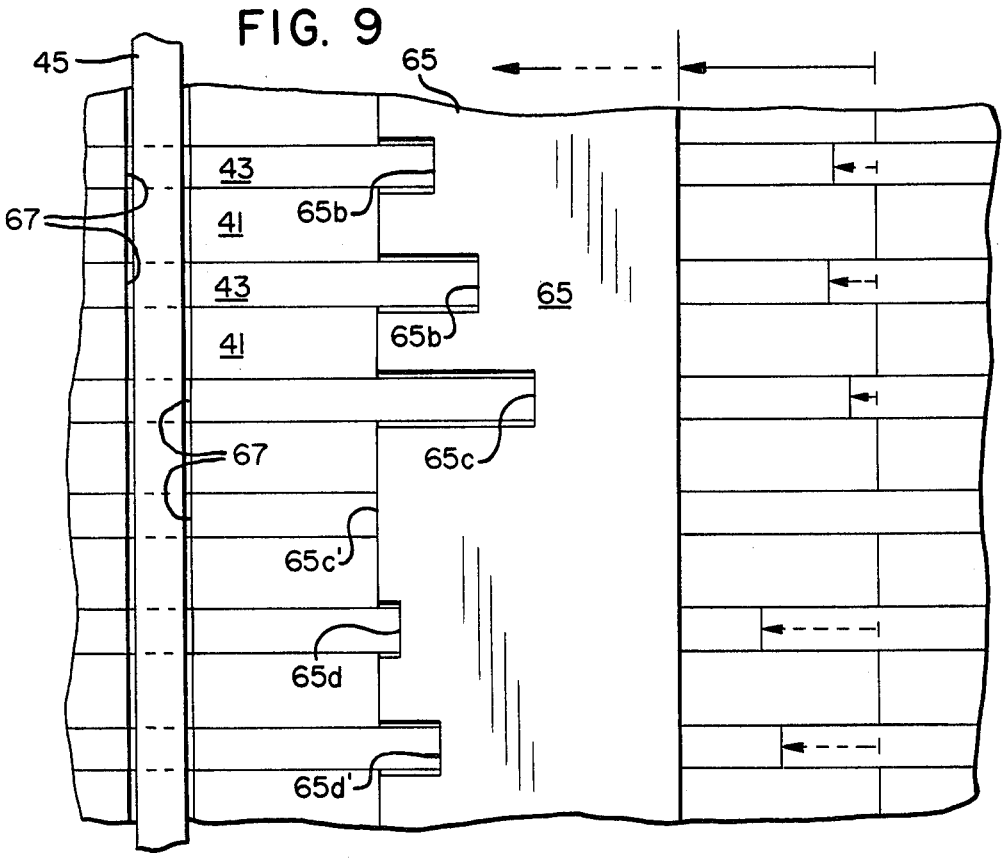
FIG. 9 is a view similar to FIG. 8 but showing a subsequent stage of operation of the lock.

FIGS. 8 and 9 show that the bits on the key 65 are staggered circumferentially, and the code notches 67 on the code discs are similarly staggered and are spaced from the bits as the parts are shown in FIG. 8. After the key is inserted and turned during its first stage of movement, the different bits on the key are brought into selective engagement with shoulders at the ends of the wide notches 63 of the code discs, to move the code discs to positions where the code notches 67 are aligned with one another (FIG. 9).

At this time, it is possible for the tumbler 45 to move radially inwardly into the code notches, but the springs 51 bias the tumbler outwardly. However, the unnotched edge portions of the key, labeled 65*j* in FIG. 8, engage the shoulders 85*a* of the actuating discs. Thus, the timing is such that the key via the actuating discs applies a circumferential force to the tumbler 45 which causes it to cam itself out of its housing notch 49, so that the tumbler enters the aligned code notches 67 on the code discs. Thus, the tumbler is cammed out of its latching position in the housing and releases the actuating discs and plugs 25 and 36. Further movement of the key turns the shaft 35 so as to move the locking member 29 from its operative locking position to its inoperative non-locking position.

When it is desired to return the locking member 29 to its locked position, the key 65 is turned in a reverse direction. Reverse movement of the key causes its rear edge 65*k* (FIG. 3) to move into engagement with the retro shoulders on the code discs (provided by notches 63) to move the internal parts in a reverse direction.

It is pointed out that FIGS. 8 and 9 are schematic views, i.e., certain lines have been left off for purposes of clarity. For instance, the lines indicating the lands 69 do not appear.

In review, the wide notches 85 in the actuating discs are wider than the key to permit clockwise movement of the key relative to the actuating discs while bringing the code discs into aligned condition. The timing is such that just as the code discs have their code notches brought into alignment with the tumbler, the key engages shoulders on the actuating discs to apply a turning force to the actuating discs, and unlock the lock. At this time, the retro edge 65*k* of the key will be spaced from the retro shoulders of the wide notches of the actuating discs, but disposed closer to the retro shoulders on the code discs. Countermovement of the key brings the key against the retro shoulders of the code discs, which action causes the actuating discs and the tumbler 45 to retro move, since the tumbler keys the discs together. After the tumbler 45 is aligned with and returned to its outward position nesting in the slot 49 (being urged to move to such position by springs 51), code discs are free to move independently of the tumbler. The key is further retro turned to misalign the code discs notches and bring them back to their initial misaligned condition, and latch the tumbler out and relock the lock.

It is recognized that once the key has been removed, the code discs may, in an unusual environment, inadvertently be shifted from their initial positions. This is undesirable because it makes entry of the key difficult. However, the shoulders at the ends of the wide notches 61 prohibit gross misalignment of the code discs relative to one another because the tumbler 45 otherwise would come into engagement with such shoulders. Nevertheless, it is desirable that the key be permitted ready entry into the lock.

In order to accomplish this, in the event that the code discs are jiggled or otherwise moved from their initial positions, a cam surface 65*m* is provided on the key (FIG. 4) which will engage the shoulders of wide notches 63 of the code discs as the key is inserted to shift the code discs around until they assume their initial positions. In fact, it may be desirable to allow the code discs to inadvertently move to positions misaligned from their initial positions, to possibly make picking even more difficult than would otherwise be the case.

In FIG. 4 the key 65 has not as yet been inserted into the lock, and FIG. 4 assumes that the code disc has inadvertently been shifted out of position, to dispose the notch 67 clockwise beyond the tumbler 45 (see also the corresponding upper notch 67 in FIG. 3). Now, as the key is inserted, its cam surface 65*m* will engage the appropriate shoulder at the end of the notch 63 and retro turn the code disc (as indicated by the arrow on the disc) to move it back to its proper initial position as shown in FIG. 6 (it being assumed in FIG. 6 that the key has been inserted into the lock).

Note that the code discs can be turned or flipped over at assembly to relocate the code notches therein, thus making for economy in producing the lock.

PICKING DIFFICULTIES

It is evident from the above description that the two stage lock is going to be extremely difficult to pick indeed. The provision of a peripheral key locates the pertinent surfaces of the code discs away from easy axial access and disposes them peripherally remote so that a person attempting to pick the lock must now have to deal with the greater inaccessibility of the pertinent surfaces of the code discs created by the peripheral key arrangement.

Referring to FIGS. 1 and 2, with the key 65 removed, a picking tool can be inserted axially into the lock through the notch 89 and into the narrow curved key-receiving recess defined on one side by the plug 36 and the peripheries of the actuating and code discs, and on the other by the interior of the guide plate 93. The picker will discover that there are discs which can be moved (the code discs) and discs which cannot (actuating discs). He is given no clue as to the purpose of the actuating discs.

The picker must now try to move the code discs circumferentially the proper distances, but the lock gives the picker no clue as to when a particular disc is at its proper position.

In addition, if a forward disc happens to be one that need not be moved at all, or very little, then the picker is faced with the problem of trying to circumferentially advance a rearwardly located code disc without disturbing the forward one. The extent of circumferential movement required can be almost the full length of the notch 61.

The flange 87 limits the extent of circumferential movement of the pick, unless the pick is made with a dog leg. Even if the pick is dog leg shaped, the picker is still faced with the unenviable task of entering axially (the dog leg pick cannot be inserted except through the notch 89) and then trying to pick by blind circumferential movement a succession of hidden code discs.

Even should the picker, by accident, come upon the code, he must then ascertain what to do next, i.e., whether pressure should be applied to one of the actuating discs before the other, or even whether pressure should be applied against the actuating discs. This is asking too much of the picker.

PREFERRED FORM OF INVENTION

FIGS. 10 through 20 show the preferred form of lock and key. Referring to FIG. 11, the lock comprises a cylindrical housing 121 which is mounted in place in the same manner as housing 21. There is a rear plug 125 held in place by a snap ring 126, the plug having a rearwardly projecting threaded stub shaft 127, of non-circular form. There is a locking member 129 non-rotatably received on the stub shaft. A stop plate 130 is arranged between the locking member and the plug 125, and is non-rotatably received on the shaft 127. A nut 131 retains both the locking member and the stop plate on the shaft.

The stop plate has two outwardly projecting lugs 132 and 133 (FIG. 12). When the plate, which turns with the actuating lugs and the stop member 129, is turned clockwise, lug 132 will abut against a rearwardly projecting portion 121*a* of the housing 121, to stop the rotation of the internal parts of the lock at the unlocked position of the locking member. When the stop plate is retro-turned (along with the internal parts), lug 133 will engage portion 121*a* to stop the actuating discs at positions where the tumbler 145 is in alignment with the notch 149. A similar arrangement could be provided on the first form of the invention.

Figure 14:
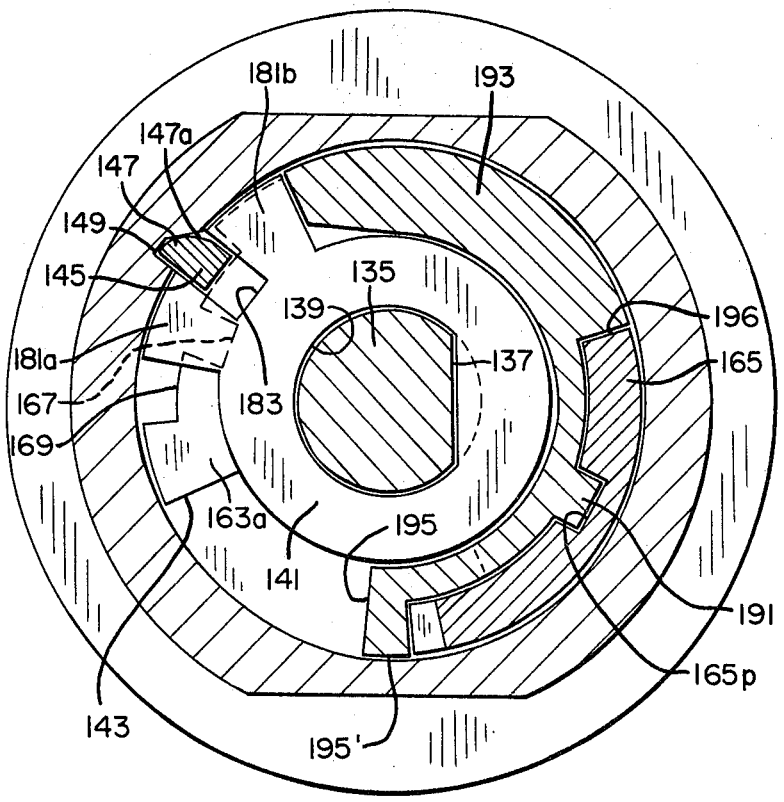
FIG. 14 is a cross sectional view on an enlarged scale taken along lines 14—14 of FIG. 11.

For convenience in disclosure, locking member 129 and housing portion 121*a* are shown in FIG. 11 as apparently in longitudinal alignment with the tumbler 145, although in fact they are circumferentially displaced from the tumbler 145, as is evident by a comparison of FIGS. 10, 12 and 14.

The plug 125 has a forwardly projecting front shaft 135 rotatably received by a front plug 136, the shaft having a flat 137 (FIG. 14). The shaft 135 is non-rotatably received within non-circular holes 139 (FIG. 13) provided in a series of actuating discs 141, while the shaft rotatably extends through circular holes 142 provided in code discs 143. A wavy spring washer 144 (FIG. 11) urges the stack of discs together.

There is a tumbler 145 having a generally triangular portion 147, which, however, has a curved surface 147*a* (FIG. 14) rather than a flat surface, for better movement into and out of a notch 149 in the interior of the housing 121. There are a pair of compression springs 151 (FIG. 11) urging the tumbler 145 to remain in the groove or notch 149. The tumbler 145 slidably fits in slots 153 and 155 formed in the plugs 126 and 136, respectively.

Figure 13:
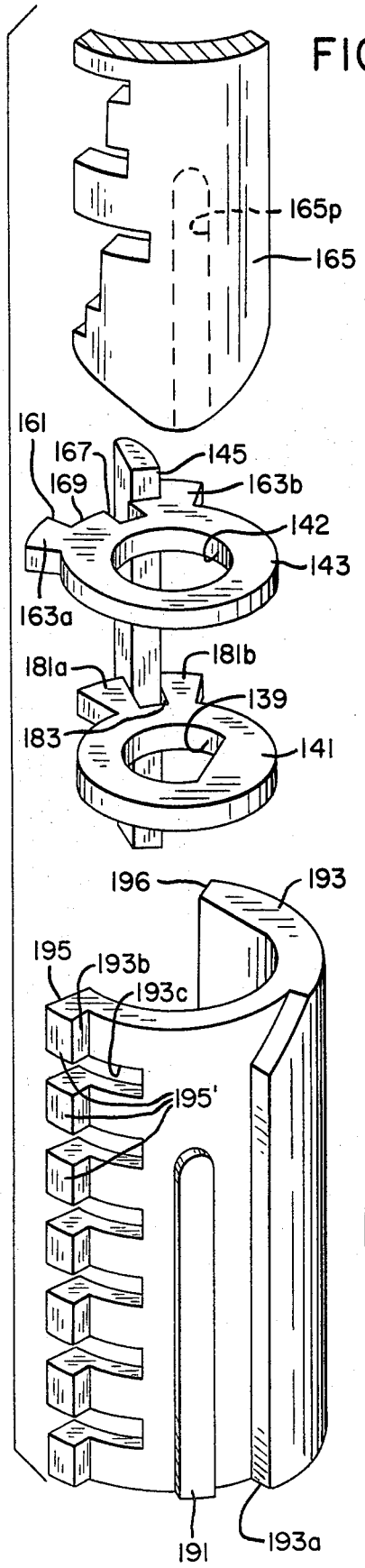
FIG. 13 is an exploded view of the preferred form of the invention showing the general relationship of the key to the code and actuating discs and guide plate.

Referring to FIG. 13, each of the code discs has a double notch portion 161, but the wide notch 63 provided in code disc 43 of FIG. 4 has been so extended for code disc 143 as to leave only a pair of lugs 163*a* and 163*b*. The key 165 is curved, as shown, and its width is such that it can pass with lateral lost motion between the lugs 163*a* and 163*b*. The double notch portion of the code disc has a narrower code notch 167, which is differently located in the double notch portion 161, i.e., located differently relative to the lugs 163*a* and 163*b* for different code discs. As shown in FIG. 13, the tumbler 145 rests on a land 169 which will prevent inward movement of the tumbler until all of the code discs have their code notches aligned with the tumbler.

Referring to FIGS. 11, 13 and 18, but particularly to FIGS. 11 and 18, the key of FIG. 18 is shown as having six bits 171, 172, 173, 174, 175 and 176, one for each of the code discs of FIG. 11. While bits 172, 174 and 176 are wider (in an axial direction) than the other bits, all could be made of the same width. However, if so, projecting bits 172 and 174 would be rather thin and thus weaker than the wider bits. Despite the difference in widths, the bits are regularly spaced, as regards their center lines, so as to properly line up with the code discs.

Referring to FIG. 13, each of the actuating discs has a pair of lugs 181*a* and 181*b* defining a deep notch 183 to at all times slidably receive the tumbler 145.

Referring to FIGS. 10 and 11, the housing has at its front an inner flange 187 in which is formed a circular hole 188 (FIG. 10) which has a notch 189 formed therein to accommodate the key. The front plug has a forwardly projecting portion 190 occupying a portion of the opening or hole 188. The plug is, however, cut away as shown in FIGS. 10 and 11 to accommodate the key and its necessary movement relative to the plug.

The key 165 has a dog leg 165*f* (FIG. 11), which, when the key is turned from its FIG. 10 insertion position, moves behind the flange 187 to preclude withdrawal of the key, until the key is retro-turned to its insertion position. FIG. 11, being a midsectional view taken on FIG. 10, should show the dog let free of the flange 187. However, for convenience in illustration, the dog leg is shown behind the flange to indicate the cooperative relationship of the parts.

Referring now to FIG. 13, the key is formed with a keyway 165*p* to slidably fit onto a keying portion 191 of a pusher plate 193. The pusher plate is provided with a wide external slot to slidably receive the key 165, the keying portion 191 being located within the slot, which is defined on one side by an edge 193*a* and at the other side by an edge 193*b*. The edge 193*b* is broken by plural clearance slots 193*c* which accommodate the lugs of the code discs. The pusher plate may be considered as having a forward end edge 195 and a retro end edge 196.

The sliding fit of the key within the slot of the pusher plate, and the sliding fit of the keying portion 191 into the keyway 165*b* prevent wobbling of the key within the lock.

Plug 136 is formed generally like plug 36 (as described on page 7), but proportioned to fit against or accommodate the parts associated with plug 136. This means that the flange 187 fully overlaps the forward recessed front face 136*a* (FIGS. 10 and 11) of the plug 136, when the internal parts are in their initial positions (the ones shown in FIGS. 10 and 11), while part of the face will be exposed when the plug is turned during the unlocking operation.

Flange 187 also partially overlaps, radially, the rearward recessed front face 136*b* of the plug, albeit such face is spaced inwardly from such flange to accommodate movement of the dog leg 165*f* of the key 165.

Face 136*b* is thus exposed as shown in FIG. 10 at the front of the lock allowing a lock picker direct axial access to the interior of the lock only in a slot or recess provided to receive the key 165. More about the difficulties of picking the lock will be set forth hereinafter.

Figure 15:
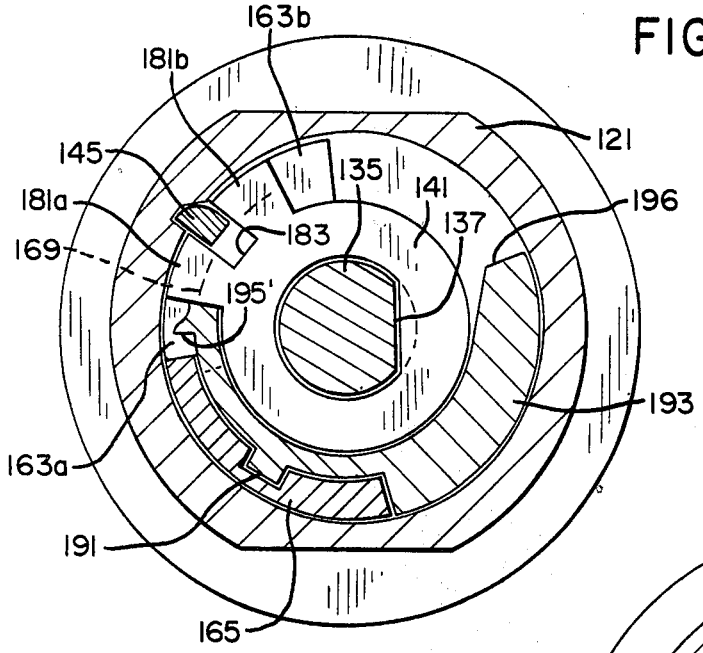
FIG. 15 is a view like FIG. 14 but showing the key and guide plate as having been turned to align the slots of the code discs with the tumbler.

Now, insofar as the operation of the lock is concerned, the key is turned from its FIG. 14 position to its FIG. 15 position at which time it is assumed that the bits on the key have engaged the lugs 163*a* on the code discs and moved them around in accordance with the code of the lock so that their code notches are aligned with the tumbler 145. At this time, the forward edge 195 or crenelations 195′ left by the clearance slots 193*c*, come into engagement with the lugs 181*a* on the actuating discs. Thus, further movement of the key now cams the tumbler inwardly into the code notches to unlatch the internal parts of the lock from the housing 21 to allow the parts to be turned to the FIG. 16 unlocking position.

Figure 16:
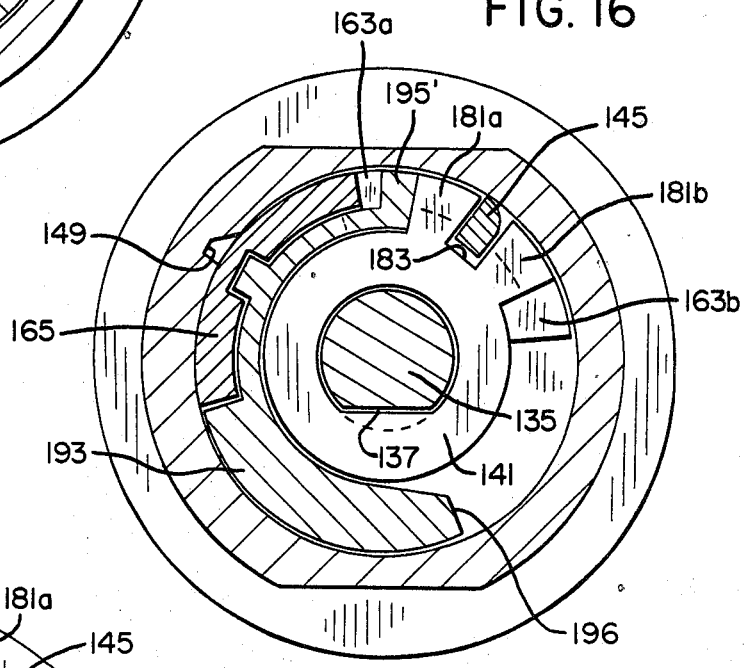
FIG. 16 shows a subsequent stage of operation.
Figure 17:
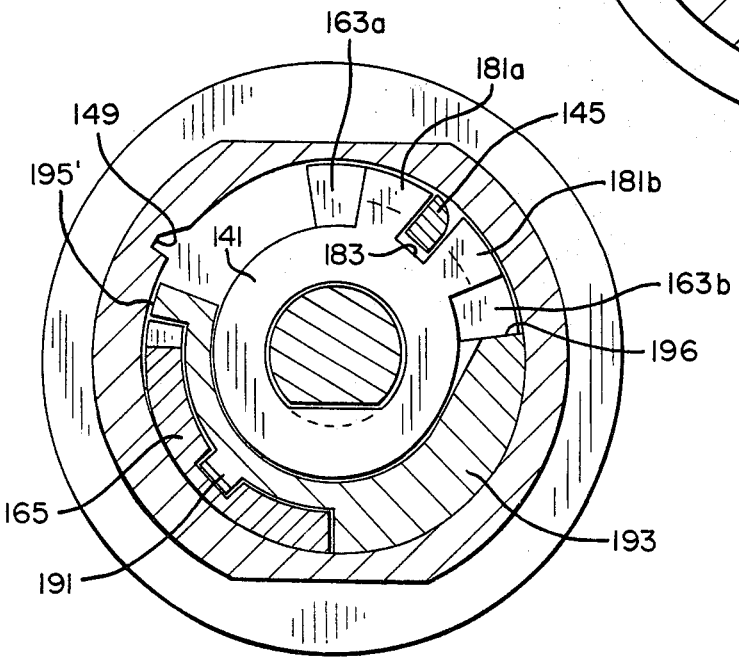
FIG. 17 shows a still further stage of operation.

It is pointed out that the lug 132 on the stop plate 130 is so located relative to the rearwardly projecting stop element 121*a* on the housing 121 as to allow the FIGS. 14–16 movement of the parts and to stop the movement at the FIG. 16 position. Note that the stop member does not have to accommodate all of the movement of the pusher plate. Movement of the pusher plate from the FIG. 14 position around until it first contacts the lugs 163*a* on the code discs in no way moves the plug 125 or the shaft 135, nor does movement of the pusher plate and the associated key from the FIG. 14 position to the position in FIG. 15 (where the code discs are in alignment with the tumbler 145) turn the shaft 135 or the plug or the locking member 129. Thus, it is only movement of the parts from the FIG. 15 to the FIG. 16 position that is accommodated by the stop member 130 and its stop lug 132.

In FIG. 16 note that the retro edge 196 of the pusher plate is spaced from the lugs on the code discs and the actuating discs. To relock the lock, the key is turned from its FIG. 16 to its FIG. 17 position to bring the edge 196 into engagement with the lugs on the code discs. The code discs, being effectively locked together and to the actuating discs by the tumbler 147, when moved, will carry with them all the internal parts of the lock, back to the FIG. 15 position. The tumbler 145 will be biased outwardly by the springs 151 into the notch 149.

At this time, the dog leg 165*f* of the key will be behind the flange 187, and thus the key cannot be withdrawn, even if inadvertently, the user so tried. Thus, the key must be retroturned further, so that through the pusher plate, the code disc notches are moved out of alignment with the tumbler 145. This latches the tumbler in its outer position, which effectively latches the locking member 129 in its locking position. By the time the key reaches its FIG. 10 insertion position, the retro edge 196 of the pusher plate will have forced all the code discs around until the retro edges of their lugs 163*b* are aligned with the retro edges of the lugs 181*b* of the actuating discs. This action returns the code discs to their fully scrambled positions, where the frictional contact, created by the spring washer 144 (FIG. 11) at the faces of the code discs, will retain them in unscrambled condition, until they are forceably moved therefrom by subsequent operation of the key.

Referring to FIG. 11, preferably the diameter of each code disc, in the zone between its lugs 163*a* and 163*b*, is made less than the corresponding diameter of the actuating discs. This means that the pusher plate will be supported by and rub against the actuating discs, rather than the code discs. This avoids any possibility of rubbing action of the pusher plate against the code discs, which might inadvertently move them.

PERIPHERAL KEY

An important part of the invention is the key. Key 65 of the first form of the invention and key 165 of the preferred form have similarities and differences. They are similar in that both are peripheral keys and in that each has (a) a dog leg portion to facilitate movement of the inner operative key portion back of a concealing flange which limits access to the interior of the lock; (b) lateral curvature to fit other curved parts and be thereby constrained against lateral wobbling movement by nesting against such other curved parts, and (c) a guide means, shown in the form of a longitudinal slot (65*h* for key 65 in FIG. 4, and 165*p* for key 165 in FIG. 13).

The keys differ in that (a) key 65 is designed to fit within the guide plate 93, while the key 165 is designed to fit against the outer surface of pusher plate 193, (b) key 165 has an additional anti-wobble constraint by fitting within a slot in pusher plate 193 (although a similar slot could be formed interiorly in guide plate 93 for key 65); (c) key 65 engages both the code discs and the actuating discs, while it is pusher plate 193 (forming, in effect, an extension of key 165) which engages the actuating discs; and (d) key 65 has a code aligning cam surface 65*m*, while key 165 has no such surface.

DIAGRAMMATIC DISCLOSURE

Figure 22:
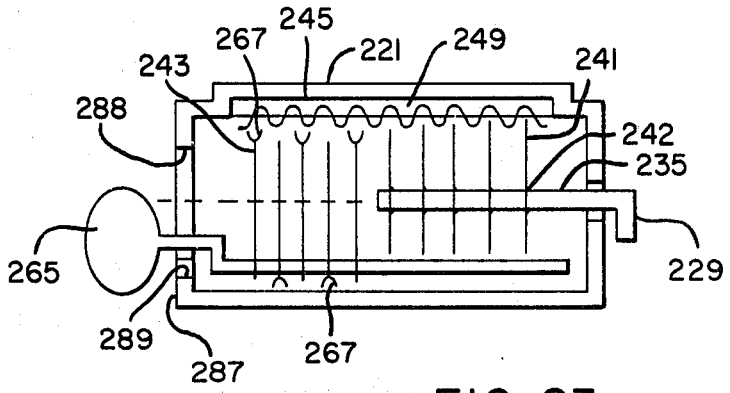
FIG. 22 is a diagrammatic view showing part of the theory of operation of the locks of the present invention.
Figure 23:
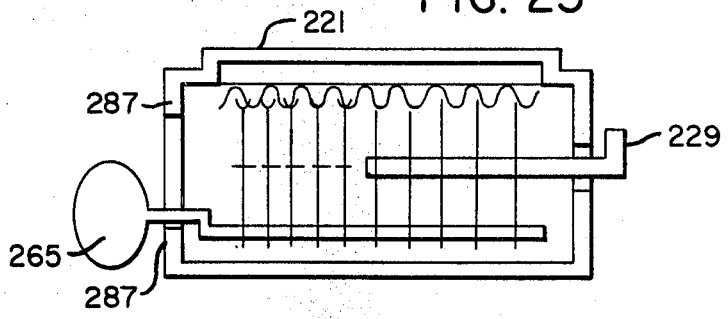
FIG. 23 is a view like FIG. 22 but showing a subsequent stage of operation.

FIGS. 22 and 23 are a diagrammatic disclosure relating to the two forms of the invention disclosed in the present application. Certain liberties have been taken with the disclosure in order to make it more readily understood. For convenience, the parts in FIGS. 22 and 23 will be given a 200 series number, corresponding to the numbering systems of the first forms of the invention, except for the first digit.

Thus, FIG. 22 shows that the lock has a housing 221, a locking member 229 mounted on a shaft 235 and non-rotatably associated with a series of actuating discs 241. The weld marks at 242 are to indicate this non-rotatable connection. There are also a series of code discs 243 associated with a tumbler 245, fitting in a notch 249 in the housing 221. For convenience, the code discs and actuating discs are shown in separate groups rather than interleaved. Also note that the shaft 235 is shown as extending short of the code discs to indicate tht they have no operative effect on the code discs (albeit in practice the shaft 235 would rotatably pass through the code discs).

There is a key 265 passing in operative relationship through or past the code discs 243. However, to show the key has no immediate effect on the actuating discs, the latter are shorted on the down ends. Also to show the constant operative relationship between the actuating discs and the tumbler, the actuating discs are shown as having short connecting elements to the tumbler, although in practice, of course, this is not so and instead there are the deep slots in the actuating discs which at all times receive the tumbler.

FIG. 22 also shows that the code notches 267 are out of alignment with one another. For convenience in FIG. 22, the misalignment is shown as being regular, but in practice it would be in accordance with the code common to the key and the code discs. FIG. 22 also shows the front opening or hole 288 in the flange 287, and the notch 289 at the periphery of this hole.

FIG. 23 assumes that the key has been turned to bring the code notches of the code discs into alignment with the tumbler, and that the tumbler has been cammed downwardly to unlatch the internal structure from the housing 221, and further that the key has been so turned as to move the locking member from its locked position to its unlocked position. For convenience, the key has been left in FIG. 23 in the same position as it is in FIG. 22, but it is presumed to have been turned so that in FIG. 23 the notch 289 would not show up, but the covering internal flange 287 would come into play insofar as concealing the inner workings of the lock.

One feature not shown in FIGS. 22 and 23 is the curved guide or pusher plate for receiving the key, because no satisfactory way could be found to incorporate it in the diagrammatic sketches. However, the pusher plate 193 is particularly important in making the preferred form of lock difficult to pick, which will now be explained.

FIG. 14 shows the key disposed in its initial inserted position within the lock, nesting in aligned condition within the wide slot of the pusher plate 193. Note the considerable circumferential distance between the key and the lugs 163*a*. This means that anyone trying to pick the lock has to insert the pick axially into the key slot in the pusher plate and then probe at right angles circumferentially through the clearance slots 193 of the pusher plate (or shove the pusher plate around) and try to contact the code disc lugs 163*a*. Determining their location gives no clue as to the code of the lock. In addition, even should the picker by accident happen to move the code discs to positions with their code notches in alignment with the tumbler, no indication is given of this fact. It would require the unusual and bizarre coincidence of someone by accident moving the code discs at the proper places and simultaneously applying pressure to the actuating discs. Note that the movement of the pick circumferentially beyond the edge 189*a* of the notch 189 cannot be done unless the pick has a dog leg (because of the radial overlap of 187 relative to the plug face 136*b*). Even if it does, the dog leg cannot be shifted axially back and forth to enable it to engage the various code lugs of the code discs. This means that a single pick is capable of contacting only a single code disc lug. Thus a series of dog leg picks must be used.

Furthermore, assume that a code disc is moved beyond the proper position, i.e., beyond the point where its code notch 167 registers with the tumbler 145. What the picker now needs to do is to retro move the code disc. In other locks, this might be done by probing around circumferentially toward the back side or back edge of the appropriate lug. However, in the preferred form of lock of the present invention, the pusher plate blocks the way, as is evident from FIG. 14. True, the pusher plate can be retro moved. However, this will indiscriminately move all of the code discs, not the single code disc desired. Thus the picker must start all over again.

What is claimed is:

1. A lock comprising:

a stationary cylinder, plural first rotary discs in said cylinder having their peripheries immediately adjacent the interior surface of said cylinder, plural second rotary discs in said cylinder for actuating a locking member and having their peripheries immediately adjacent the interior surface of said cylinder, a latching means latching said second discs, but not said first discs, against movement, said first discs normally retaining said latching means in latching condition, but operable when moved to predetermined positions to enable said latching means to unlatch.

2. A lock comprising:

a housing, plural rotary discs within said housing, a latching bar for interconnecting said housing and at least certain of said discs, certain of said discs each having a pair of peripheral lugs straddling said bar but spaced apart a distance greater than the width of said bar to provide a shoulder for supporting said latching bar, at least certain of the just mentioned discs each having a radially inwardly extending notch located in the shoulder and between the associated lugs and of a size to receive said bar, at least certain of said notches being located circumferentially differently from other of said notches, and means whereby at least certain of said discs can effect actuation of a locking member.

3. A lock as described in claim 2 in which, for certain of said discs, the spacing of said lugs for each disc is the same as the width of the associated notch.

4. A lock comprising:

a cylinder having a front wall formed with a circular opening interrupted by a notch, a key insertable within said cylinder through said notch, said key having a radially outwardly projecting dog leg portion received within said cylinder and a handle portion projecting from said cylinder radially inwardly of the circumference of said circular opening to thereby facilitate turning of said key within said cylinder to a position to locate said dog leg portion behind said front wall.

5. A lock comprising a housing, plural discs turnably mounted within said housing, a front plug forwardly of said discs and turnably mounted within said housing, a rear plug rearwardly of said discs and turnably mounted within said housing, an axial member extending between said plugs and through said discs, latching means between said housing and said plugs and certain of said discs and restraining the same against movement relative to said housing, other of said discs having peripheral key engaging surfaces and being turnable by key actuation relative to said latching means to predetermined positions to release said latching means from said housing, and a locking member connected to said certain discs.

6. A lock comprising a housing, plural rotary discs in said housing, latching means latching certain of said discs against movement relative to said housing, and latching said certain discs for conjoint movement when movement is permitted, other of said discs adapted to be key actuated to actuate said latching means so as to release said certain discs for movement, a shaft projecting axially through said discs and having a rotary relationship with said other discs and adapted for connection to a locking member, said shaft having a non-rotary relationship with said certain discs, whereby movement of said certain discs effects movement of the locking member via said certain discs.

7. A lock as recited in claim 6 in which said other discs having peripheral bits, and a peripheral key for engaging said peripheral bits.

8. A key for a tumbler lock comprising:

an elongated member, said member including a handle portion and an operating portion connected together by a dog leg or stepped portion in which the riser portion is essentially planar but the operating portion and the portion of the handle adjacent the riser are both curved about an axis parallel to the length of the key, and bits formed on the key.

9. A key as recited in claim 8 in which the bits are formed on an edge of said operating portion and are of crenelated form.

10. A key as recited in claim 9 in which the operating portion has a longitudinally extending guide element in the form of a slot.

11. A lock comprising a housing, plural rotary discs in said housing, latching means latching certain of said discs against movement, said certain discs when moved adapted to actuate a locking member, other of said discs having key-engaging peripheral lug means having forward edges for engagement by a peripheral key for moving said discs to positions to disable said latching means whereby to release said certain discs, said lug means having rear edges to facilitate imparting retro movement to said other discs to return them to their starting positions, and an anti-picking member disposed adjacent to and in circumferential alignment with said rear edges so as to be interposed between said rear edges and a key whereby to facilitate retro movement of said other discs by the key via said member, but to preclude access by a lock picker to such rear edges when the key is removed.

12. A lock as recited in claim 11 in which said member is an arcuate sector fitting between the interior of said housing and the exterior of said discs.

13. A lock as recited in claim 11 in which there are forward and rearward plugs in said housing, said discs and member fitting between said plugs.

14. A lock as described in claim 11 wherein there is a key, said member and key having an interfitting relationship.

* * * * *